US007975736B2

(12) United States Patent
Poutanen

(10) Patent No.: US 7,975,736 B2
(45) Date of Patent: Jul. 12, 2011

(54) JOINT BETWEEN WOOD PIECES

(76) Inventor: Tuomo Poutanen, Tampere (FI)

( * ) Notice: Subject to any disclaimer, the term of this patent is extended or adjusted under 35 U.S.C. 154(b) by 181 days.

(21) Appl. No.: 11/720,377

(22) PCT Filed: Nov. 28, 2005

(86) PCT No.: PCT/FI2005/000511

§ 371 (c)(1),
(2), (4) Date: May 29, 2007

(87) PCT Pub. No.: WO2006/056651

PCT Pub. Date: Jun. 1, 2006

(65) Prior Publication Data

US 2008/0121312 A1 May 29, 2008

(30) Foreign Application Priority Data

Nov. 29, 2004 (FI) ..... 20041529

(51) Int. Cl.
*B27F 1/00* (2006.01)

(52) U.S. Cl. ..... 144/347; 403/364

(58) Field of Classification Search ..... 144/347, 144/85–89, 82, 67, 69–71, 74, 75, 134.1, 144/135.3; 52/693, 633, 793.1, 841, 838, 52/847, 848, 854, 846; 428/106, 60; 403/219, 403/364

See application file for complete search history.

(56) References Cited

U.S. PATENT DOCUMENTS

| | | | | | |
|---|---|---|---|---|---|
| 242,513 | A | * | 6/1881 | Crane | 403/382 |
| 389,684 | A | * | 9/1888 | Beach | 403/364 |
| 1,359,399 | A | | 11/1920 | Lewis | |
| 2,413,912 | A | * | 1/1947 | Dosker | 403/384 |
| 2,780,842 | A | | 2/1957 | Hess | |
| 3,452,502 | A | | 7/1969 | Price | |
| 3,480,054 | A | * | 11/1969 | Marian | 144/347 |
| 3,507,524 | A | * | 4/1970 | Steidle-Sailer | 403/219 |
| 3,592,717 | A | * | 7/1971 | Gaughran | 428/106 |
| 3,692,340 | A | | 9/1972 | Roth | |
| 3,720,050 | A | | 3/1973 | Rozinka | |
| 3,867,803 | A | * | 2/1975 | Platt | 52/693 |
| 4,057,356 | A | * | 11/1977 | Nissen | 403/219 |
| 4,074,498 | A | * | 2/1978 | Keller et al. | 52/690 |
| 4,383,780 | A | * | 5/1983 | Davison | 403/219 |
| 4,624,295 | A | * | 11/1986 | Howland | 144/347 |
| 4,684,282 | A | * | 8/1987 | Lever | 403/219 |
| 5,203,639 | A | * | 4/1993 | Femrite | 403/382 |
| 5,650,210 | A | * | 7/1997 | Fujii et al. | 428/57 |
| 5,653,080 | A | * | 8/1997 | Bergeron | 52/839 |
| 2005/0102955 | A1 | * | 5/2005 | Kennelly et al. | 52/633 |
| 2006/0101785 | A1 | * | 5/2006 | Wiercinski et al. | 52/793.1 |
| 2006/0201097 | A1 | * | 9/2006 | Davis | 52/633 |

FOREIGN PATENT DOCUMENTS

| | | | |
|---|---|---|---|
| CA | 1099473 | | 4/1981 |
| CA | 2008043 | | 7/1991 |
| FR | 2058315 | | 5/1971 |
| GB | 1359399 | | 7/1974 |
| GB | 1359399 | A * | 7/1974 |
| WO | WO-98/01636 | | 1/1998 |
| WO | WO-2004/094842 | | 11/2004 |

* cited by examiner

*Primary Examiner* — Dana Ross
*Assistant Examiner* — Jennifer Chiang
(74) *Attorney, Agent, or Firm* — Stites & Harbison PLLC; Douglas E. Jackson

(57) ABSTRACT

A joint between wood pieces, such as between timber, laminated timber, LVL, plywood etc., includes one or more bars forming a diagonal of a truss. A side of another bar forms a truss chord. The bars are connected to each other by a finger joint. The truss chord is asymmetrically.

3 Claims, 1 Drawing Sheet

JOINT BETWEEN WOOD PIECES

FIELD OF INVENTION

The invention relates to a truss joint and, in particular, a truss having two diagonal bars connected to a cross bar via a finger joint.

BACKGROUND

Previously known are several ways to connect the other bar or several bars on the side of a wooden bar. Such joints are for instance the T- or K-joint between the chord of a wooden truss or between one or more diagonals, for example U.S. Pat. No. 3,507,524, U.S. Pat. No. 1,359,399 and FR 20583315. Hereinafter the connection pieces are called chord and diagonal, although the applications of the new joint are not restricted to trusses, with which, for instance, the said terms are connected. Essential in such a joint is what kind is the joint cutting of chord. This cutting is done with a cutting tool so that in the chord between the ends of the cutting area one or more grooves or fingers are formed in the chord direction. As to its breadth the cutting area can be as broad as the whole chord or only a part of it. Present joints have various problems:

- wood is cut unnecessarily so, which weakens the firmness of the wood.
- For the part prior chords are cut symmetrical, e.g., GB 1359399 and U.S. Pat. No. 3,702,050, which is not optimal concerning the firmness, since the tensions are divided into the joint almost always asymmetrically.
- Wood is cut outside the joint area, which also reduces the firmness of the wood, e.g., U.S. Pat. No. 3,452,502.
- In addition to the connection pieces nails screws, boards, etc., are needed, which add to the costs, e.g., AT 361203. The different parts of the joint are dependent of each other among others so that the cutting of one part has effect on the cutting of the other part, for instance so that the cutting of male or of the female cutting has effect on the choice of the cutting type by another cutting or so that the joint must be put together in a certain order.
- The fingers are visible outside the joint, which is unaesthetical, in addition water and dirt can harmfully gather in the finger grooves.
- It is not possible to use quick hardening glues, e.g., hot melt glue which sets in less than a minute, since all the prior joint bars, and in practice, the whole structure must be joined simultaneously, which would take as much time as the time it takes for the glue to harden.
- By production accurate positioning of connection pieces is not easy, because the cuttings do not locate the connection pieces exactly.
- The joints have discontinuities which lead to accumulations of tension and weakening of firmness, whereas an ideal firmness is obtained with a uniform tension distribution.
- The cutting groove of the chord is along the grain, e.g., CA 2008043, due to which the wood splits easily along the edge of the cutting groove. In order to prevent this breaking form the cutting groove should separate as much as possible from the grain direction. A good result is also achieved so that the cutting groove is as crooked as possible.
- Inside the joint there are cavities, e.g., GB 1359399 and U.S. Pat. No. 2,780,842, which make the joint weaker, because on the cavity edges peaks of tension are formed.

Further, the cavities are harmful, because water can penetrate into them from the gap or cracks in the joint.

- The diagonals must be installed on the side of the chord perpendicularly with respect to it or in almost perpendicular direction, which in some cases restricts the assembly of parts, for instance the assembly of a truss put together of parts. Further, the angle edge and diagonal cannot be smaller than the angle characteristic for a certain type of joint, which reduces the operational range of the joint. Before cutting of fingers the ends of bars must be shaped to be in accordance with the joint. This gives rise to costs of labour and material.
- Present finger joints are not suited for making three-dimensional joints without separate connection pieces, e.g., WO 2004/094842.

SUMMARY OF INVENTION

The invention is directed to a truss having two diagonal bars connected to a cross bar via a finger joint. By means of the invention it is possible to get rid of the above presented problems. The new joint is better than the previous ones, more versatile, easier to produce, firmer and visually in relation to its quality of higher level. In the joint there are some new solutions and advantages connecting to them:

- A little wood is cut from the chord, i.e., the cutting depth is small. However, concerning the firmness it is often necessary that the depth of cutting must be quite deep at least in some part of the joint. It is essential that the cutting depth is fitted so that the depth cut in the part of the joint, minimizes the disadvantage caused by cutting. For example, the cutting depth is adjusted to correspond to the required minimum of firmness and considering assemblage of the joint. The cutting depth is adapted to be optimum in the middle of joint and separately in both routing ends. It is usually enough in long joints that the chord is cut deep only from the joint ends, and in the short joints that wood is cut deep only from one end. If the stresses of joint are small the chord is not cut deep at all i.e., the maximum routing depth is approximately the finger height or even less. Sometimes, for instance in the chord end joint, the firmness of chord is secondary and that of the joint is primary, especially splitting of the chord along grain at the groove bottom, whereby plentiful asymmetrical cutting of the chord gives a good result. Even in this case, the chord is cut a little. Cutting can also be carried out so that from the edge areas of chords, less wood is cut than from the middle. Among others, this can take place so that in the cutting tool there can be fingers of different length or so that the fingers of the middle and of the chord edge areas are cut separately.
- The finger cutting of chord is usually asymmetric in the chord direction, thus the geometric form of joint can be fitted to correspond to the asymmetric distribution of stress.
- Wood is not cut outside of the joint area.
- In addition to glue, there are no other joining means in the joint, such as nails, boards etc. Sometimes it is advantageous to use screws by the assembly of joints, especially when the finger joints do not lock sufficiently, so that the piece to be assembled can be moved from the assembly station before the glue gets hard.
- The different parts of the joint are independent of each other, for instance the cuttings of different parts can be done independent of other parts and the connection pieces can be assembled in any order. By the assemblage of parts the rotational motion can be utilized.

In the joints there are neither visible fingers nor any harmful nests of dirt or water. One way to realise invisible finger joints is fitting the heights and widths of fingers to be alternating. This technology is described in detail in the inventor's other application for a patent, which is delivered on the same day as this application.

In the joint quickly hardening glue can be used. This because each part can have glue application and be individually fixed in place independent of other parts. Assembling can be interrupted after fixing of each part. This fact is of great importance, if the parts are heavy, heavier than about 40 kg, e.g., gluelam beams or other parts of wood, which have to be handled by lifts or other machines.

Each part of the joint is self-locating, i.e., the mutual position of two parts is determined unambiguously from the cuttings, when the fingers are compressed.

There are no discontinuities in the joint, since the fingers are high in middle of the joint and short in the ends, due to which no great tensions arise in the ends.

The cutting groove is not in the direction of the grain of the piece to be cut and the cutting groove is crooked in a maximal way, so splitting of wood along the chord of the cutting groove is not possible. In order to produce a crooked cutting groove the diameter of the cutting tool is small, usually smaller than 50 mm plus the height of the fingers. Splitting of wood from the chord of the cutting groove can be prevented also so that parallel cutting grooves reach to different depths of the chord, especially so that the fingers in the middle are the longest. A good solution is also a such one, where there is in the joint only one finger longer than the others or alternatively a separate connection piece.

There are no cavities in the joint. There can be in the joint small gaps caused by inaccuracy of the cutting tool and restrictions of the form geometry of the cutting grooves. For this reason it is advantageous to use in the joints inexpensive, so called filling glue, which works still in a gap of 0.5 mm.

Because of the form-flexibility of the joint the parts can be connected to each other in an oblique angle. Further, the connection bars can by fitting be turned in regard to each other. This fact, for instance, is of great importance in roof trusses of building. Manufacture can be carried out so that the chords of the truss are at first positioned to their proper places and then the diagonals are connected between the chords. This is not possible if the diagonals could not be turned and also not connected to the chords in oblique angles. Finger gluelam trusses are nowadays assembled so that during installation of the diagonals the chords are further from their final position. When the diagonals are put in places, the chords are compressed.

The fingers can be cut in right angle or in semicircular shape in the ends of cut-off wooden pieces, whereby roughing down the ends before cutting of fingers is not needed or the ends are shaped only a little, so the wastage of material is small.

The new joint is suited without separate connection pieces also to the structures of a three-dimensional joint, i.e., a joint, where in many levels there are diagonals connected to the chord. In three-dimensional structure many diagonals are connected to the chord, whereby the quantity of wood to be removed is great and this is critical in view of the entire firmness. In the joint as per the invention wood is cut only a little, so the drop of firmness is slight. The three-dimensional joint as per this invention is especially suited to three-dimensional joints, where the chord is circular or a polygon, the diagonal bar of which is perpendicular in regard to the side of the polygon.

BRIEF DESCRIPTION OF THE DRAWINGS

FIG. 1 is a partial sectional view and FIGS. 2 and 3 are view taken along lines a-a and b-b, in FIG. 1, respectively;

DETAILED DESCRIPTION OF THE INVENTION

Figure 1:
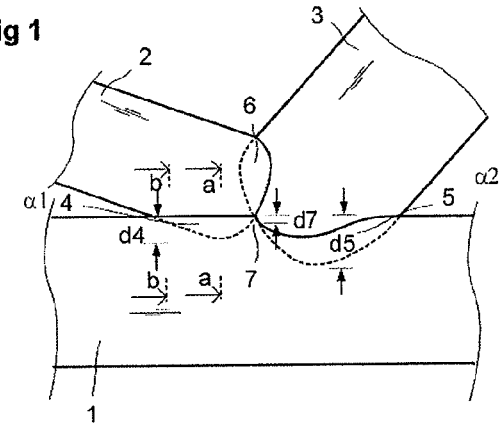
FIGS. 1, 2, 3 depict a joint of two wooden parts as diagonals to the side of another wooden part, as a chord, where
Figure 2:
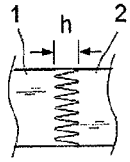
Figure 3:
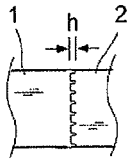

In FIGS. 1, 2, 3 the finger joint is composed of a diagonal of two wooden parts i.e., connecting pieces 2 and 3, as a truss, on the side of a chord of other wooden part 1. FIGS. 2 and 3 show the section of joint area 4 fingers called herein finger routing. The fingers get shorter in the ends of the joint area. In this case the fingers of part 2 get thicker while getting shorter. Finger cuttings between parts 4, 5 and 6 are presented with a uniform line, if the cutting groove is visible and with a broken line if the cutting groove (fingertip) is invisible. By cutting 4 from chord 1, a little wood is removed. The cutting depth d4 is, at its most, only the height of the cutters h of the cutting cursor i.e., finger joint cutter or less. Often the finger grooves must be cut deeper in the chord than the height of fingers h in order to achieve sufficient firmness of the joint, especially to prevent cracking rupture in the bottom of the cutting grooves. By cutting 5, the cutting depth d5 and the firmness of the joint is enhanced. The solution is advantageous, when minor cutting 4 is fitted on the side, where the tensions of chord 1 are greater. Even if a relatively large amount of wood is removed from the other side of the joint, it does not usually reduce the entire firmness, since on this side, there is an extra tolerance of firmness i.e., this side includes a margin of strength. If the joint tenses are small, rather than cutting 5, a cutting of a type like cutting 4 is used instead. There is in the middle of cutting in spot 7 a not cut punctuate area with cutting depth marked as d7. This area can have also a length so that there is between cuttings 4 and 5 a small not cut area. It is also possible that the cuttings overlap a little in regard to one another. According to the embodiment of FIG. 1, one can achieve that using cuttings 4, 5 and 6 which are independent of each other. In all of them, the male-female cutting types can be chosen independent from each other. Further parts 1, 2 and 3 can be connected to each other in any order and any angle $\alpha 1$, $\alpha 2$. The joint can be put together by moving parts with regard to each other and also circulating them. The shape of the part ends is almost round, so the parts still can be turned when the fingers are pressed almost to the final position. Further, they can have glue application and be fitted into place one by one, so that the use of quickly hardening glue, for instance glue setting in few seconds, or of glue hardening at most in about one minute, such as two-component glue or especially the use hot-melt adhesive, is possible. After fitting of each part assembling can be interrupted. The ends of parts 2 and 3 can be achieved by removing some wood from timber cut in right angle, so the wastage of material is small. Alternatively the parts can be pre-cut in the form of a semicircle. In this case the material wastage is greater but the amount of labour smaller. In the joint there are also other advantages, among others all advantages of the new joint specified above. It is often advantageous to fit the cutting grooves as in shape of circular arches, whereby cutting, planning and analysing of joint is simple. In a cutting like this the joint surface and firmness are however some smaller.

Figure 4:
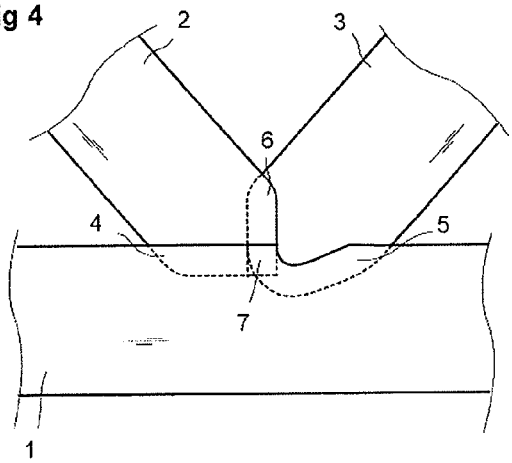
FIG. 4 shows an alternative embodiment of a joint in accordance with the present invention.

FIG. 4 shows an alternative joint, where the cutting areas and also glue surfaces firmness are greater. On the other hand some advantages of the joint of FIG. 1 are reduced. For example, cuttings 4, 5, and 6 are dependent on each other, the use of quickly hardening glue is complicated and the connection pieces are harder to position by assembly. Alternatively the joint can be made so that cutting groove 6 is according to the embodiment of FIG. 4 and the other ones are according to the embodiment of FIG. 1 or vice versa. Especially strong, and in terms of manufacture, fast and inexpensive, is provided by a joint, where cuttings 4 and 5 overlap each other, so that there are in the ends of bar 2 and 3, uniform cutting grooves, i.e., in a case according to the embodiment of FIG. 4, 4 there is in bar 2 end, a similar uniform cutting than in the bar 3 end. Especially effective is an embodiment, where the fingers are narrowing and the cuttings of chord 1 are done, without moving the cutting tool, in the direction of the axis of the finger joint tool in the way shown in FIG. 3.

Figure 5:
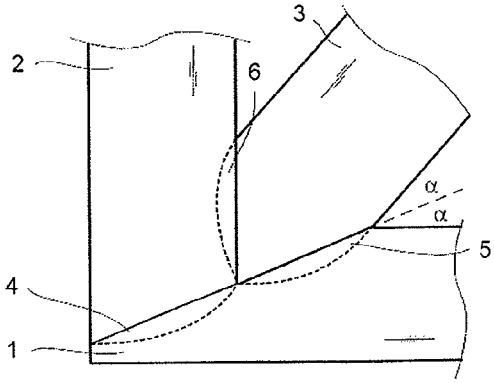
FIG. 5 shows a joint of a chord end, which is asymmetrical, in accordance with another embodiment of the present invention.

FIG. 5 shows the joint of chord 1 end, which is asymmetric in the same way as the former joints. Diagonal 2 is extended till the lower part of chord 1, whereby splitting of chord can be effectively prevented. A very large firmness is achieved, so that the cutting of diagonal 3 into chord 1 is made so that the cutting groove forms an angle as big as possible in regard to bars 1 and 3, i.e., the cutting direction is roughly parallel with the half of the connection angle. In this case all cuttings 4, 5 and 6 are circular arches.

Figure 6:
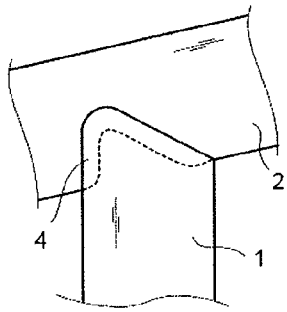
FIG. 6 shows another asymmetrical joint in accordance with the present invention.

FIG. 6 shows an asymmetric joint between chord 2 and bar 1. Deeper cutting is fitted on the side, where the loss of firmness caused by cutting is smallest/or the achievable advantage greatest, so the joint can be easily fitted.

Figure 7:
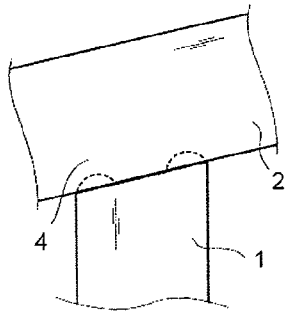
FIG. 7 shows yet another embodiment of a connection between a diagonal bar and a chord.

FIG. 7 shows an alternative joint of chord 1 and bar 2. In this case there is in the middle of cutting a not cut area. Among others the solution is useful in cases, in which the stresses are relatively small or it is possible to cut wood only a little from the chord.

In the above some solutions of the invention are presented. The inventive concept can also be applied in many other ways within the limits of the claims.

The invention claimed is:

1. A joint for wood pieces forming a truss, the truss including first and second diagonal bars with respective first and second end portions connected to each other and to a side of a chord bar as respective diagonal bars of the chord bar, said joint comprising:

a finger joint whereby the first and second end portions of the first and second diagonal bars are connected to the side of the chord bar and to each other, the finger joint including finger routing in the first and second end portions of the first and second diagonal bars and a corresponding routing in the side of the chord bar such that the finger joint has a first joint routing in the side of the chord bar, for the first end portion of the first diagonal bar, having a first side routing depth that varies from one longitudinal end to the other and which has a first maximum depth between the ends, the first finger routing being longitudinally asymmetrical to provide a unique self-locating mutual positioning of the first end portion of the first diagonal bar in the chord bar, a second joint routing in the side of the chord bar, for the second end portion of the second diagonal bar, having a second side routing depth that varies from one longitudinal end to the other and which has a second maximum depth between the ends, the second finger routing being longitudinally asymmetrical to provide a unique self-locating mutual positioning of the second end portion of the second diagonal bar in the chord bar; and a third joint routing in the connected first and second end portions of the first and second diagonal bars, the third joint routing defining a center portion of the finger joint having a center maximum routing depth extending at least to the chord bar, and at least one of the first and second maximum routing depths is greater than the maximum center portion routing depth.

2. A joint according to claim 1, wherein the chord bar has no fingers in the center portion.

3. A joint according to claim 1, wherein the chord bar has fingers in the first finger joint center portion so that the chord bar is connected to the first and second end portions of the first and second diagonal bars at the first finger joint center portion.

* * * * *